US006126004A

United States Patent [19]

Ling

[11] Patent Number: 6,126,004

[45] Date of Patent: Oct. 3, 2000

[54] TOOL DISPLAY BOX

[75] Inventor: David Ling, Taichung, Taiwan

[73] Assignee: Hand Tool Design Corporation, Wilmington, Del.

[21] Appl. No.: 09/345,349

[22] Filed: Jul. 1, 1999

[51] Int. Cl.[7] ..... B65D 85/28

[52] U.S. Cl. ..... 206/377; 206/378; 206/459.5; 206/806; 206/480

[58] Field of Search ..... 206/459.5, 806, 206/372, 373, 376, 377, 478, 480, 493, 483, 1.5; 211/70.6, 70.1; 220/345.1, 345.2

[56] References Cited

U.S. PATENT DOCUMENTS

| | | | |
|---|---|---|---|
| 2,035,340 | 3/1936 | Primavera | 220/345.2 |
| 2,941,691 | 6/1960 | Weinberg | 220/345.2 |
| 3,630,344 | 12/1971 | Bergh | 220/345.1 |
| 4,880,122 | 11/1989 | Martindell | 211/70.6 |
| 4,997,085 | 3/1991 | Brennan | 206/376 |
| 5,143,215 | 9/1992 | Hartley et al. | 206/461 |
| 5,415,315 | 5/1995 | Ramirez | 220/346 |
| 5,730,303 | 3/1998 | Chow | 211/70.6 |
| 5,782,347 | 7/1998 | Fantone et al. | 206/308.1 |
| 5,803,253 | 9/1998 | Zakarian | 206/349 |
| 5,899,329 | 5/1999 | Hu et al. | 206/376 |
| 5,931,299 | 8/1999 | Hsieh | 206/376 |
| 5,941,386 | 8/1999 | Hu et al. | 206/376 |

*Primary Examiner*—Paul T. Sewell
*Assistant Examiner*—Nhan T. Lam
*Attorney, Agent, or Firm*—Alan Kamrath; Oppenheimer Wolff & Donnelly LLP

[57] ABSTRACT

A tool display box includes a main body having a number of spaced resilient retaining plates projecting outward therefrom. A holding space is defined between each two adjacent resilient retaining plates to hold a tool by two mutually facing walls of the two adjacent resilient retaining plates. Each resilient holding plate includes a distal end having a notch defined therein. A retaining member is secured to each resilient holding plate and includes a passage aligned with the notch. A locking member is extended through the notches of the resilient holding plates and the passages of the retaining members for preventing removal of the tool in the holding space.

20 Claims, 11 Drawing Sheets

TOOL DISPLAY BOX

BACKGROUND OF THE INVENTION

1. Field of the Invention

The present invention relates to a tool display box.

2. Description of the Related Art

A well-designed tool display box may attract buyers. U.S. Pat. No. 5,899,329 to Hu, et al. issued on May 4, 1999 discloses a display tool box that includes a base having a receiving area with a plurality of recesses defined therein so as to receive tools in the recesses and an operation area having a hole defined therethrough which has a toothed inner periphery for a ratchet member rotatably engaged therewith so that a tool, such as a box end wrench is mounted to the ratchet member and can rotate the ratchet member. Nevertheless, the overall size of the display tool box is relatively large and fails to provide an anti-theft function. In addition, rotation of the ratchet member is not convenient while holding of the tools is difficult.

The present invention is intended to provide a tool display box that mitigates and/or obviates the above problems.

SUMMARY OF THE INVENTION

It is a primary object of the present invention to provide an improved tool display box that may reliably hold the tools in place.

It is another object of the present invention to provide an improved tool display box that provides an anti-theft effect to the tools.

It is a further object of the present invention to provide an improved tool display box that allows easy rotational movement of the tool to be demonstrated.

It is still another object of the present invention to provide an improved tool display box that has a descriptive board to encourage potential buyers to try new products held by the tool display box.

In accordance with a first aspect of the invention, a tool display box comprises a main body including a plurality of spaced resilient retaining plates projecting outward therefrom. A holding space is defined between each two adjacent resilient retaining plates to hold a tool by two mutually facing walls of the two adjacent resilient retaining plates.

A plurality of spaced positioning pegs may be provided for retaining an end of the tool. A rotary member is rotatably mounted to the main body for releasably engaging with an end of the tool to rotate therewith.

Each resilient holding plate includes a distal end having a guide section for guiding the tool into the holding space. The guide section of each resilient holding plate is inclined and includes a bottom surface to which a handle portion of the tool received in the holding space abuts. The distal end of each resilient holding plate includes a notch defined therein. A retaining member is secured to each resilient holding plate and includes a passage aligned with the notch. A locking member is extended through the notches of the resilient holding plates and the passages of the retaining members for preventing removal of the tool in the holding space. The main body includes a locking notch defined in an end wall thereof for releasably engaging with an end of the locking member. The main body includes a slot defined in a second end wall opposite to the first-mentioned end wall, the slot being sized smaller than the other end of the locking member.

In accordance with a second aspect of the invention, a tool display box comprises:

- a main body including a plurality of spaced resilient retaining plates projecting outward therefrom, a holding space being defined between each two adjacent said resilient retaining plates and being adapted to hold a tool, each said resilient holding plate including a distal end with a notch defined therein;
- a retaining member secured to each said resilient holding plate and including a passage aligned with the notch; and
- a locking member extended through the notches of the resilient holding plates and the passages of the retaining members for preventing removal of the tool in the holding space.

In accordance with a third aspect of the invention, a tool display box comprises:

- a main body including an insert space;
- a retaining means provided on the main body for holding at least one tool;
- a rotary member rotatably mounted to the main body for releasably engaging with an end of said at least one tool to rotate therewith; and
- a board releasably mounted in the insert space, the board including information on said at least one tool.

The tools are retained in place by the resilient holding plates, and an anti-theft effect is provided by the locking member. When the descriptive board is inserted into the insert space, the information is exposed via a window defined in the main body at an appropriate location. Thus, one can be attracted and encouraged to play with the tool. The buyer will be satisfied because he/she may try on operation of the ratchet-type combination wrench before buying it.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
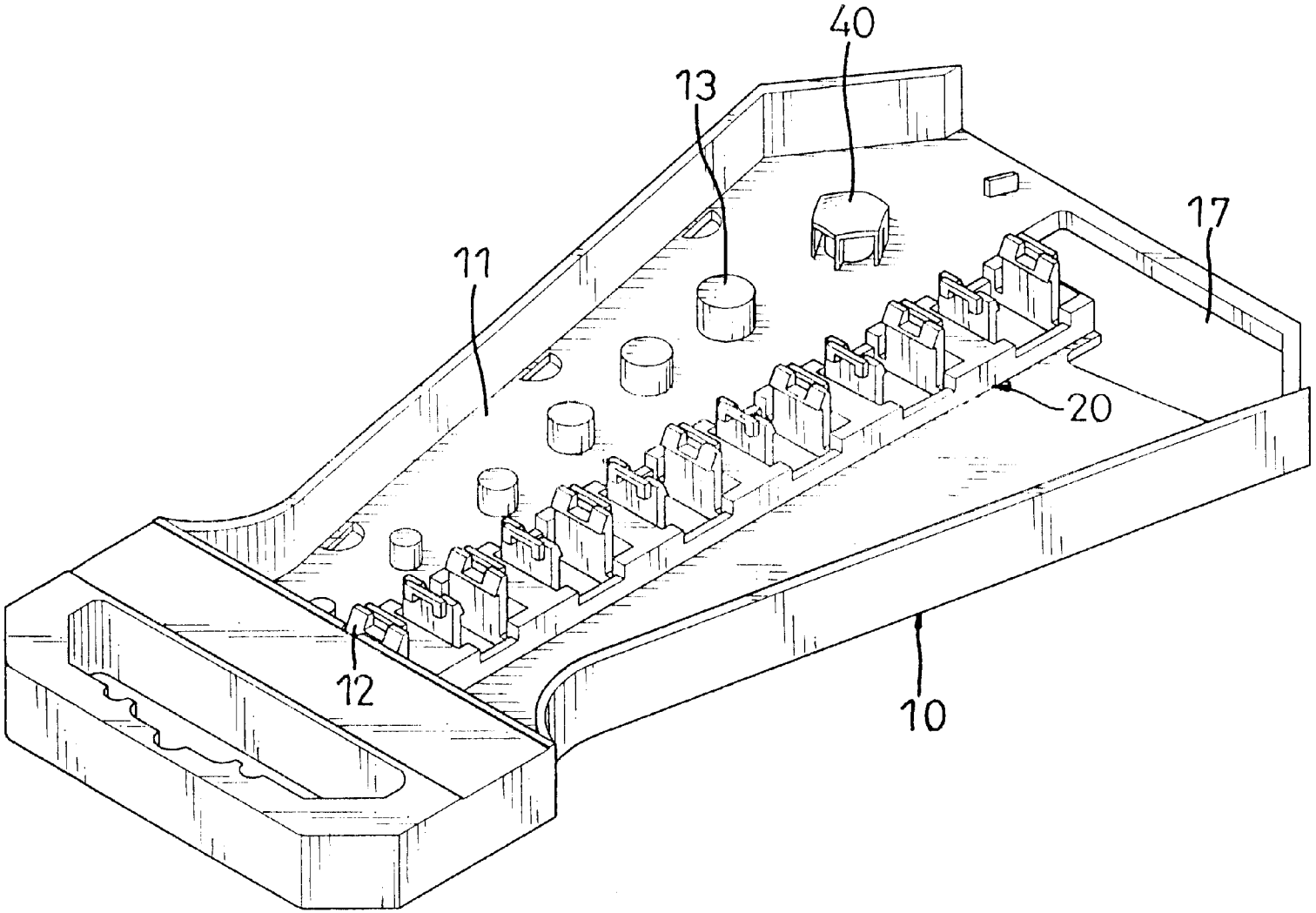
FIG. 1 is a perspective view of a tool display box in accordance with the present invention.
Figure 2:
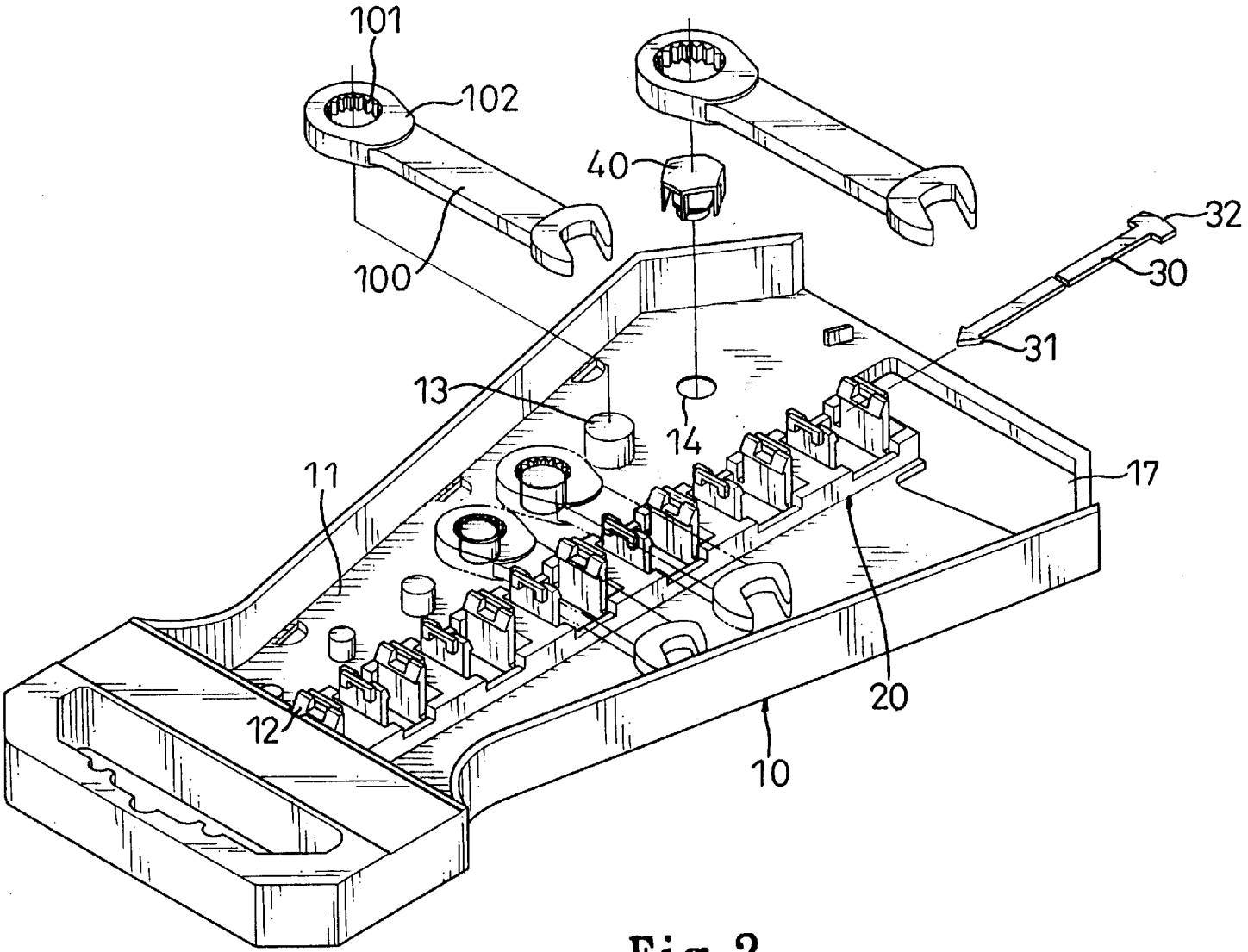
FIG. 2 is a perspective view, partly exploded, of the tool display box in accordance with the present invention.

Referring to FIGS. 1 through 11 and initially to FIGS. 1 and 2, a tool display box in accordance with the present invention generally includes a main body 10 having a compartment 11 defined therein. A retaining means 20 is provided on the main body 10 and located in the compartment 11, which will be described later. The main body 10 further includes a locking notch 12 in an end wall thereof. A number of spaced positioning pegs 13 of different diameters are formed on the main body 10 and located on one side of the retaining means 20. The main body 10 further includes a toothed hole 14 that will be described later.

Figure 3:
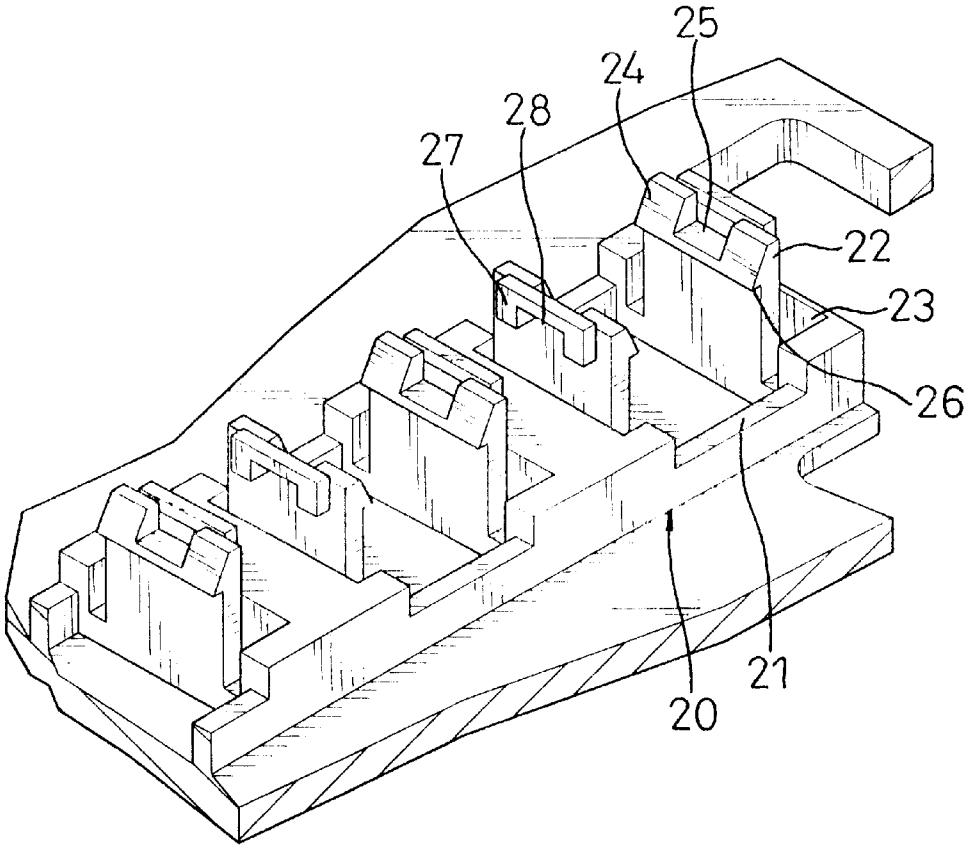
FIG. 3 is a fragmentary perspective view illustrating a portion of the tool display box.
Figure 4:
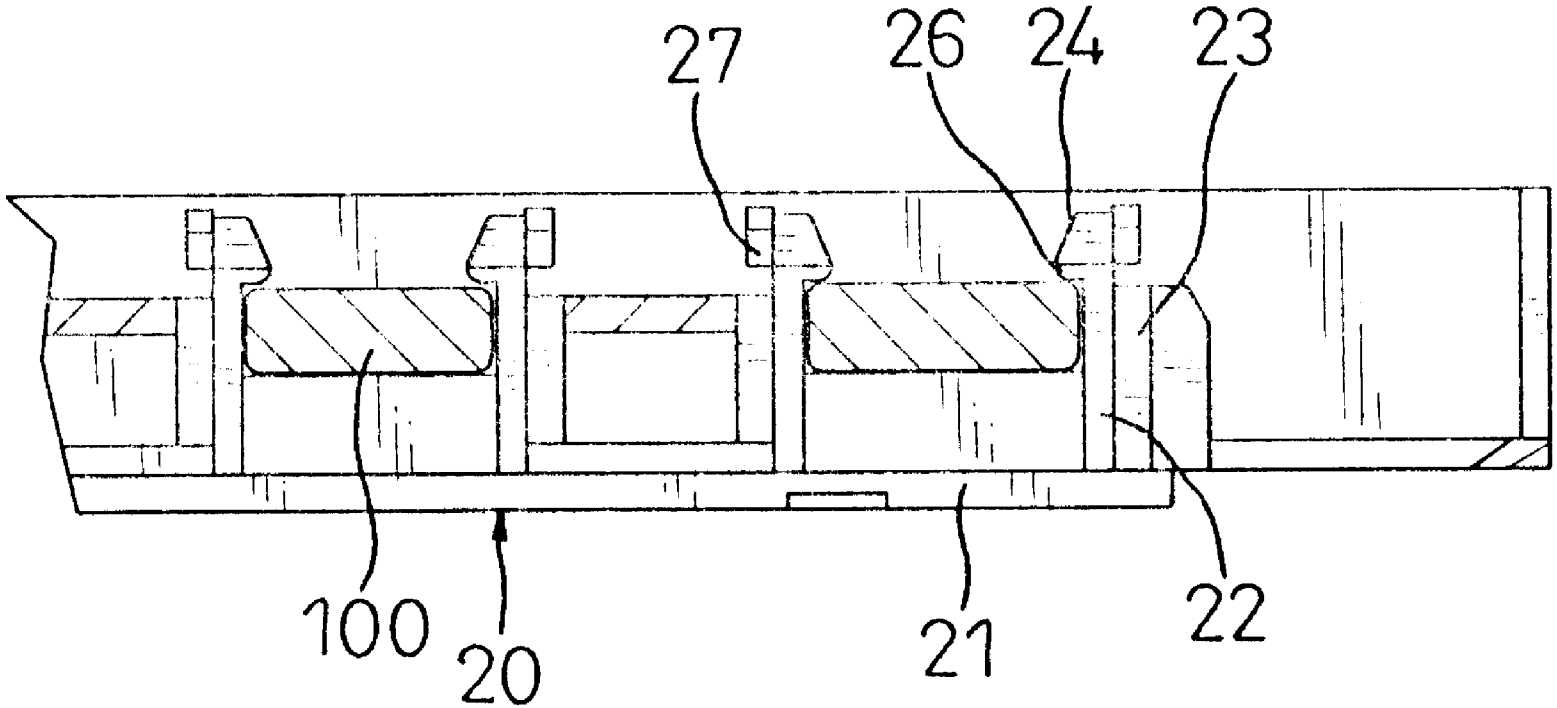
FIG. 4 is a sectional view of the portion of the tool display box in FIG. 3.

Referring to FIGS. 3 and 4, the retaining means 20 includes a plurality of spaced resilient holding plates 22 that project outward from the main body 10, wherein a holding space 21 is defined between each two adjacent resilient holding plates 22. Each resilient holding plate 22 is flexible (a space 23 is defined beside the resilient holding plate 22 to allow such flexible motions) to allow a tool (e.g., a ratchet-type combination wrench 100) to be inserted into the holding space 21. Each resilient holding plate 22 includes an inclined guide section 24 in a distal end thereof for guiding the combination wrench 100 into the holding space 21, the inclined guide section 24 including a bottom surface 26, which will be described later. In addition, the distal end of each resilient holding plate 22 includes a notch 25 defined therein and an inverted U-shaped retaining member 27 secured thereto, the inverted U-shaped retaining member 27 defining a passage 28 that aligns with the notch 25.

In use, tools (e.g., combination wrenches) of different sizes are held in the associated holding spaces 21. The toothed hole 101 of the box end 102 of each combination wrench 100 is engaged with an associated positioning peg 13. In addition, as can be seen from FIG. 4, the handle portion (not labeled) of each combination wrench 100 is securely held between two associated resilient holding plates 22 with an upper side of the handle portion abutting against the bottom surfaces 26 of the guide sections 24 of the associated resilient holding plates 22. Thus, a reliable holding effect for the combination wrenches 100 is provided.

After placing the combination wrenches 100 into the holding spaces 21, a locking member 30 is extended through the aligned notches 25 and passages 28. The locking member 30 includes a first end 31 that is releasably engaged with the locking notch 12 of the main body 10 and a second end 32 for manual grasp. Thus, direct removal of the combination wrenches 100 is not available, thereby providing an anti-theft function.

Figure 5:
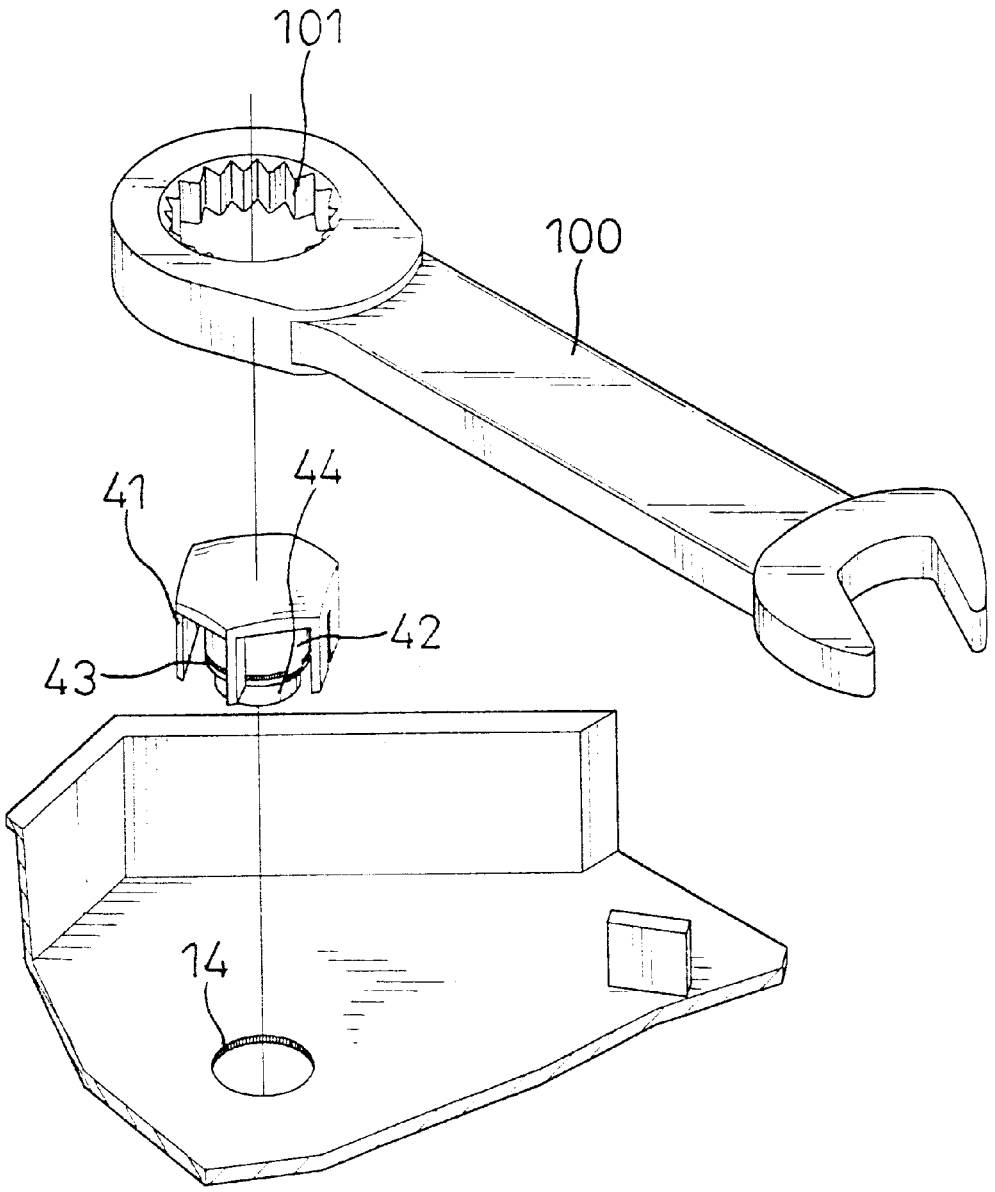
FIG. 5 is an exploded perspective view illustrating another portion of the tool display box in accordance with the present invention.

Referring to FIG. 5, a rotary member 40 is rotatably mounted to the main body 10. In this embodiment, the rotary member 40 includes a block 42 and a number of posts 41 projected outwardly from an extended peripheral edge of the block 42 to thereby enclose the block 42. The block 42 including a distal end 44 having an annular toothed section 43. The main body 10 includes a toothed hole 14 for rotatably engaging with the annular toothed section 43 of the rotary member 40. The rotary member 40 can be mounted to the toothed hole 14 by means of force fitting.

Figure 6:
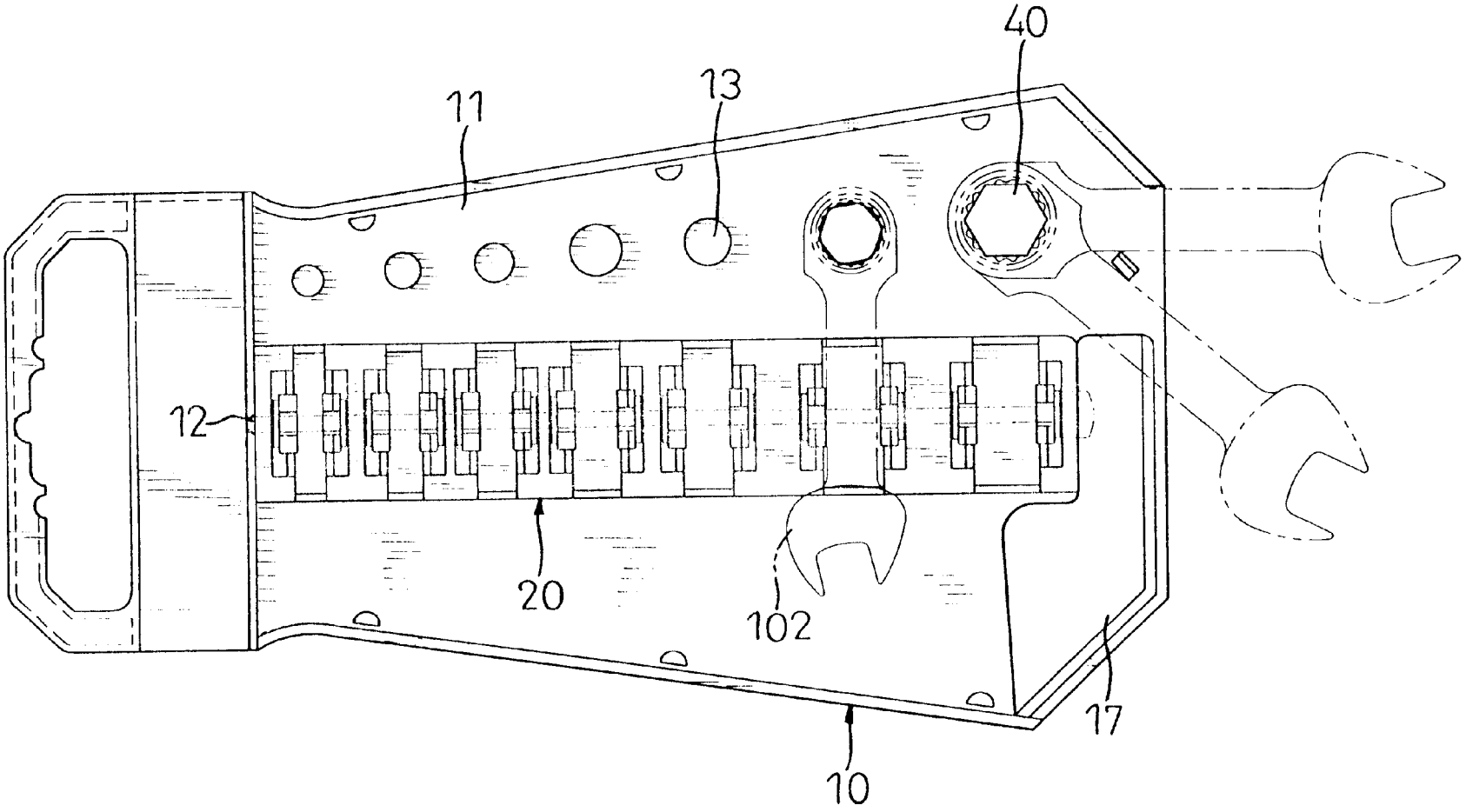
FIG. 6 is a top view of the tool display box in accordance with the present invention.
Figure 7:
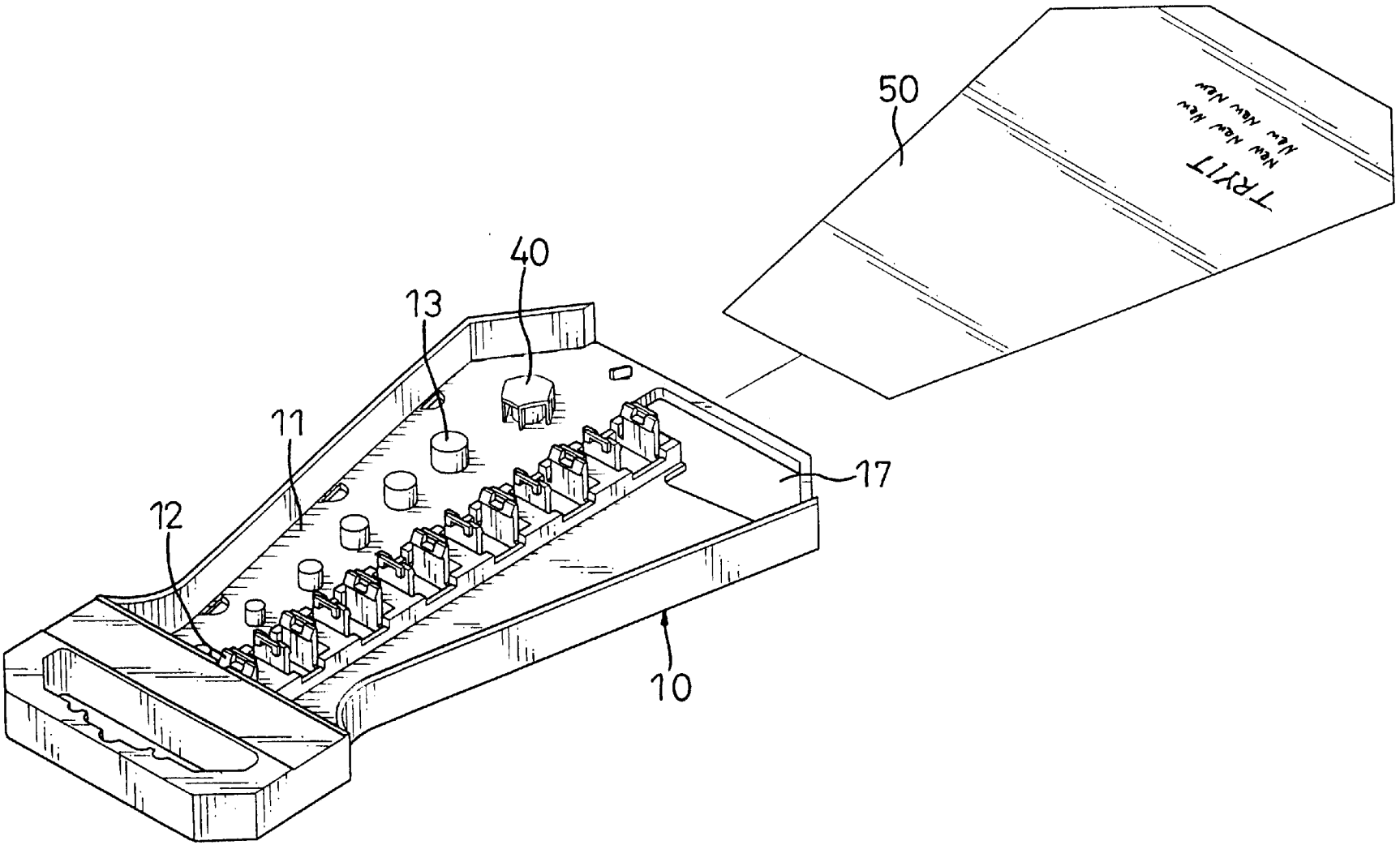
FIG. 7 is an exploded perspective view of the tool display box and a descriptive board in accordance with the present invention.
Figure 8:
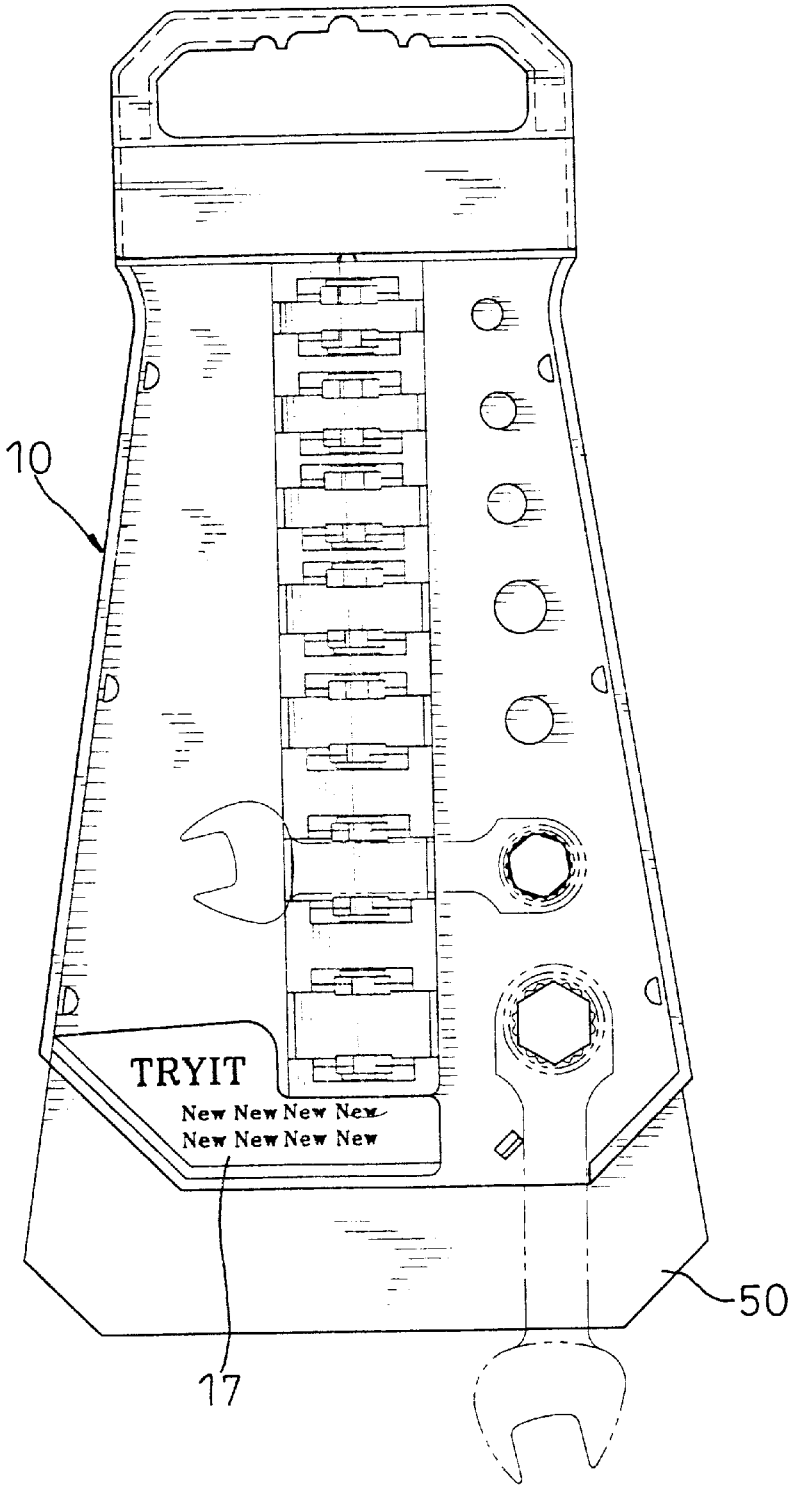
FIG. 8 is a top view of the tool display box in accordance with the present invention with the descriptive board mounted thereto.
Figure 9:
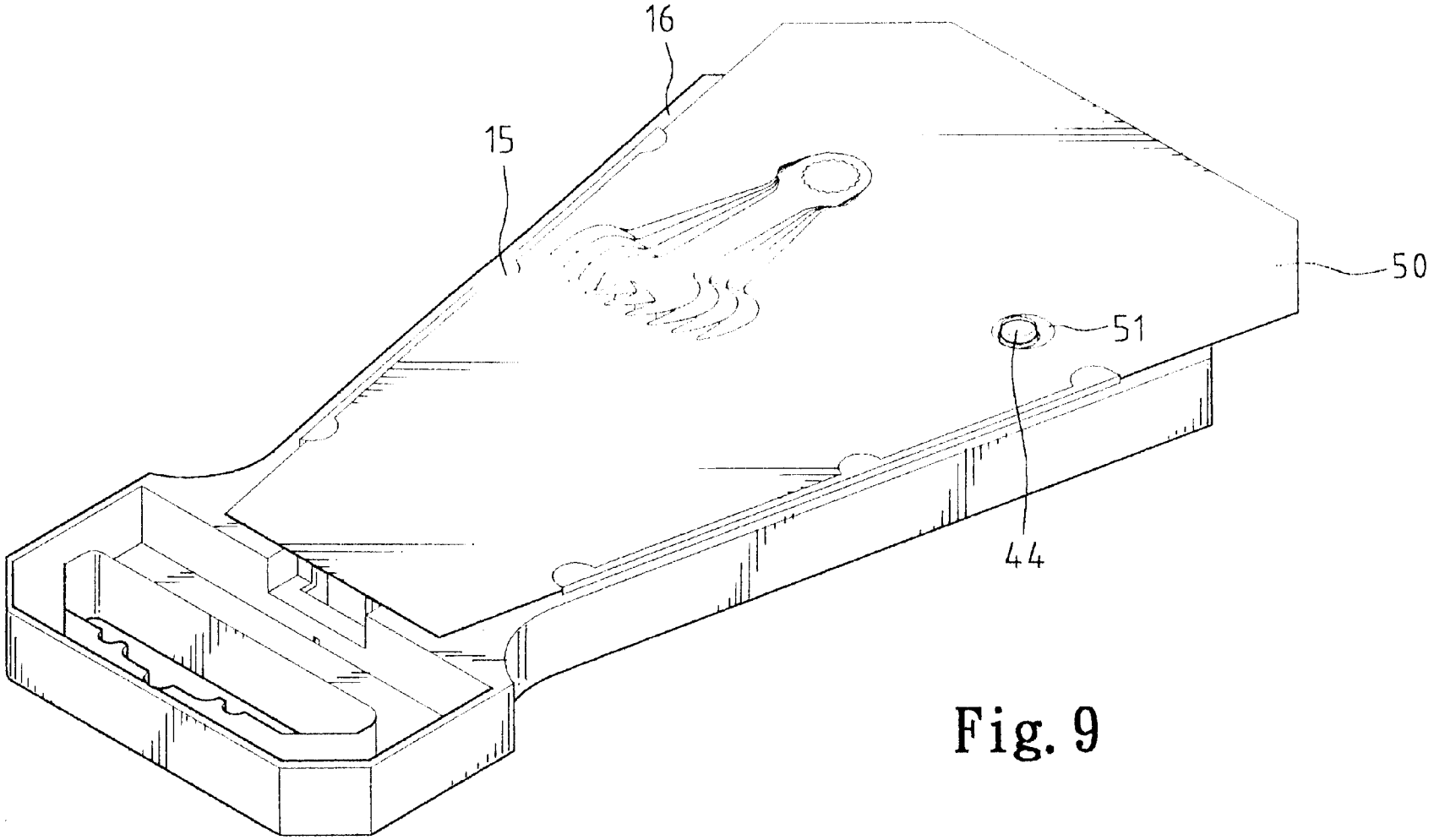
FIG. 9 is a bottom perspective view of the tool display box in accordance with the present invention with the descriptive board mounted thereto.

Referring to FIG. 6, when the box end 102 of a combination wrench 100 is engaged with the rotary member 40, one can "try on" the combination wrench 100 before deciding to buy it or not. Rotary motions of the wrench 100 is smooth and easy to operate. The ratchet-type combination wrench 100 is a newly developed product that includes a ratchet means (not shown) in the box end 102 thereof such that the box end 102 may act as a ratchet wrench. Structure and operation of such ratchet-type combination wrench 100 are beyond the scope of the invention and therefore not further described. In addition, a descriptive board 50 may be provided to further appeal the potential buyers. Referring to FIGS. 8 and 9, the main body 10 includes a number of protrusions 15 formed on each of two lateral edges of an underside thereof to thereby define an insert space 16 for receiving the descriptive board 50. The descriptive board 50 includes descriptive or commercial words (information) on at least one side thereof. When the descriptive board 50 is inserted into the insert space 16, the descriptive or commercial words are exposed via a window 17 defined in the main body 10 at an appropriate location. The description board 50 includes a hole 51 to expose the distal end 44 of the block 42 of the rotary member 40. Thus, one can be attracted and encouraged to play with the wrench 100. The buyer will be satisfied because he/she may try on operation of the ratchet-type combination wrench 100 before buying it.

Figure 10:
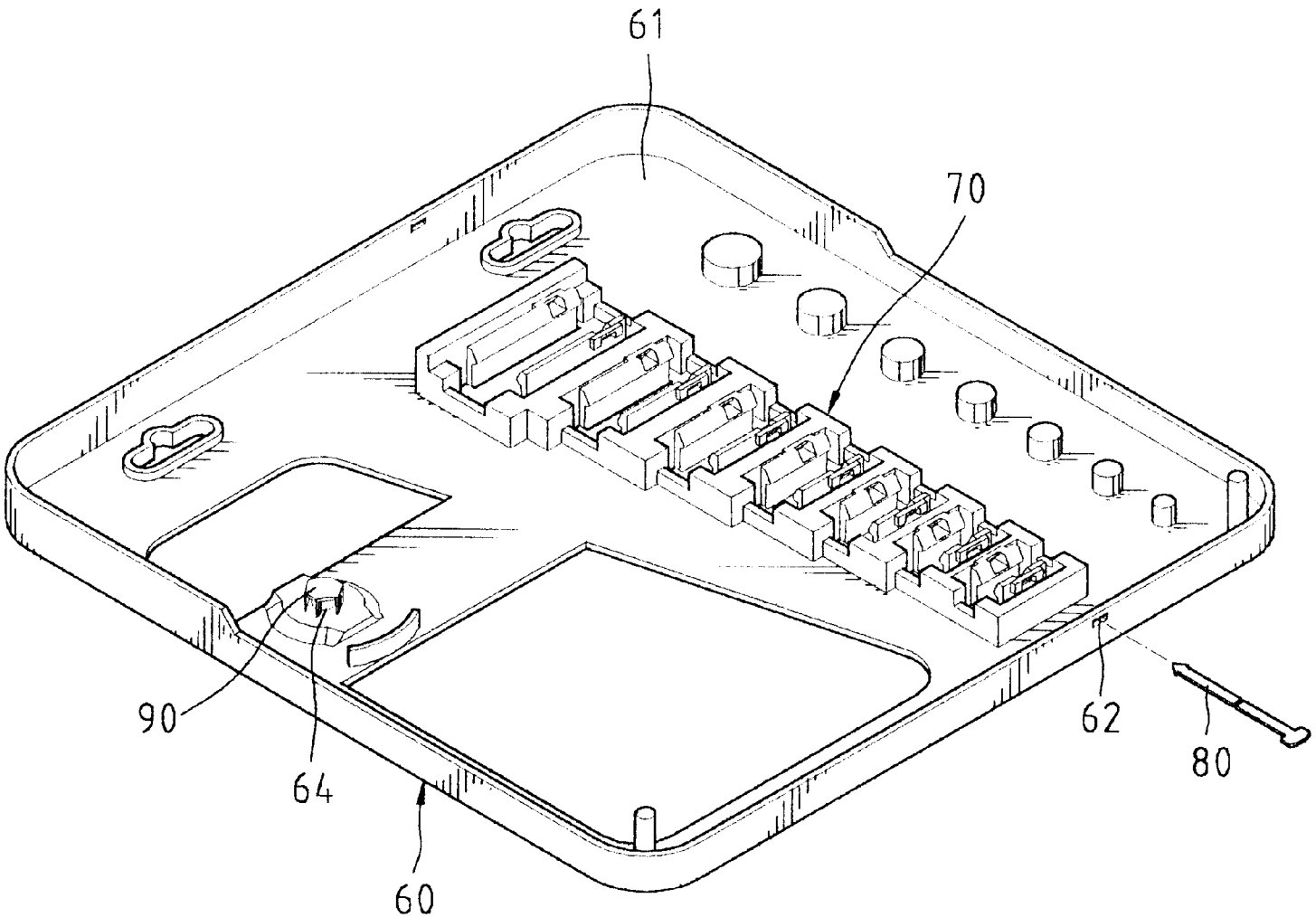
FIG. 10 is a perspective view of a modified embodiment of the tool display box in accordance with the present invention.
Figure 11:
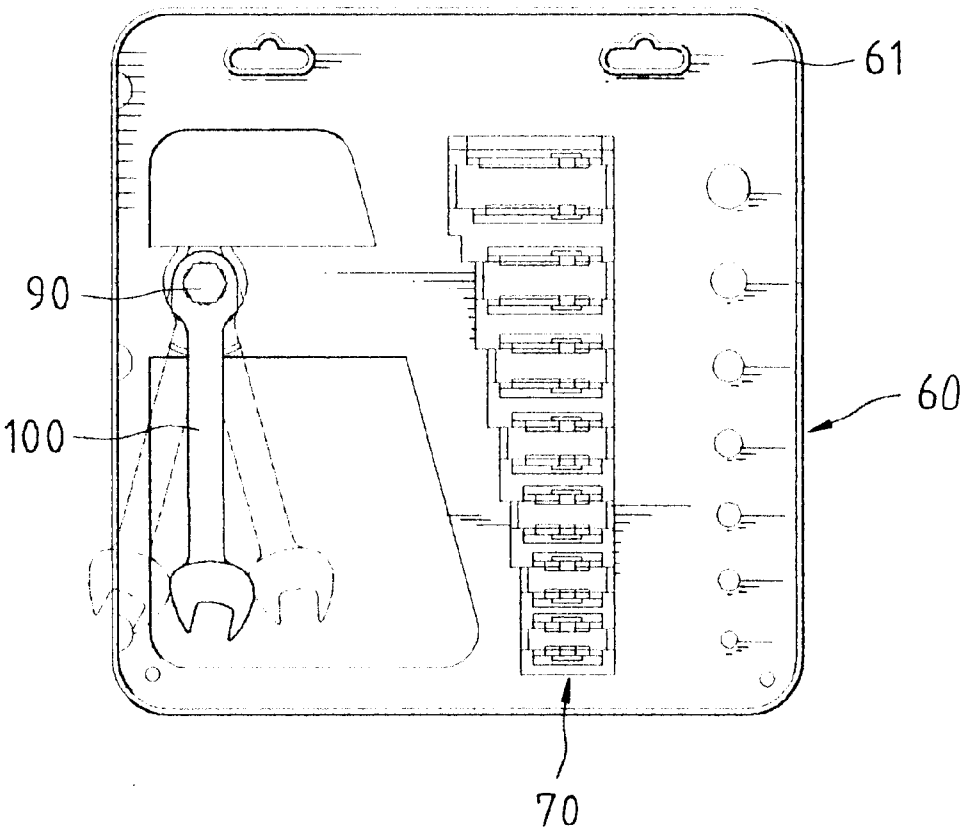
FIG. 11 is a top view of the modified embodiment of the tool display box.

FIGS. 10 and 11 illustrate a modified embodiment of the tool display box in accordance with the present invention. The tool display box includes a substantially square main body 60 defining a compartment 61. A retaining means 70 (identical to the retaining means 20 of the first embodiment) is provided on the main body 60. A slot 62 is defined in an end wall of the main body 60 and is sized smaller than the second end (not labeled) of the locking member 80 (identical to the locking member 30 of the first embodiment) so as to indicate proper locking position of the locking member 80. In addition, the main body 60 includes a toothed hole 64 for rotatably engaging with a rotary member 90 (identical to the rotary member 40 of the first embodiment) for demonstrating operation of new products (ratchet-type combination wrenches).

Although the invention has been explained in relation to its preferred embodiment, it is to be understood that many other possible modifications and variations can be made without departing from the spirit and scope of the invention as hereinafter claimed.

What is claimed is:

1. A tool display box comprising, in combination:

a main body including a plurality of spaced resilient retaining plates projecting outward therefrom, a holding space being defined between each two adjacent and resilient retaining plates and being adapted to hold a tool by two mutually facing walls of the two adjacent resilient retaining plates, wherein each said resilient holding plate includes a distal end, and wherein the distal end of each said resilient holding plate includes a notch defined therein;

a retaining member secured to each said resilient holding plate and including a passage aligned with the notch; and a locking member being extended through the notches of the resilient holding plates and the passages of the retaining members for preventing removal of the tool in the holding space.

2. The tool display box as claimed in claim 1, further comprising a plurality of spaced positioning pegs for retaining an end of the tool.

3. The tool display box as claimed in claim 1, further comprising a rotary member rotatably mounted to the main body for releasably engaging with an end of the tool to rotate therewith.

4. The tool display box as claimed in claim 1, wherein the distal end of each said resilient holding plate includes a guide section for guiding the tool into the holding space.

5. The tool display box as claimed in claim 4, wherein the guide section of each said resilient holding plate is inclined and includes a bottom surface to which a handle portion of the tool received in the holding space abuts.

6. The tool display box as claimed in claim 1, wherein the main body includes a locking notch defined in an end wall thereof for releasably engaging with an end of the locking member.

7. The tool display box as claimed in claim 6, wherein the main body includes a slot defined in a second end wall opposite to the first-mentioned end wall, the slot being sized smaller than the other end of the locking member.

8. The tool display box as claimed in claim 7, further comprising, in combination: a board including information on the tool, with the main body including an insert space, with the board being releasably mounted in the insert space.

9. The tool display box as claimed in claim 7, wherein the distal end of each said resilient holding plate includes a guide section for guiding the tool into the holding space.

10. The tool display box as claimed in claim 1, further comprising, in combination: a board including information on the tool, with the main body including an insert space, with the board being releasably mounted in the insert space.

11. A tool display box comprising:

a main body including a plurality of spaced resilient retaining plates projecting outward therefrom, a holding space being defined between each two adjacent said resilient retaining plates and being adapted to hold a tool, each said resilient holding plate including a distal end with a notch defined therein;

a retaining member secured to each said resilient holding plate and including a passage aligned with the notch; and a locking member extended through the notches of the resilient holding plates and the passages of the retaining members for preventing removal of the tool in the holding space.

12. The tool display box as claimed in claim 11, wherein the main body includes a locking notch defined in an end wall thereof for releasably engaging with an end of the locking member.

13. The tool display box as claimed in claim 12, wherein the main body includes a slot defined in a second end wall opposite to the first-mentioned end wall, the slot being sized smaller than the other end of the locking member.

14. The tool display box as claimed in claim 13, further comprising, in combination: a board including information on the tool, with the main body including an insert space, with the board being releasably mounted in the insert space.

15. The tool display box as claimed in claim 13, wherein the distal end of each said resilient holding plate includes a guide section for guiding the tool into the holding space.

16. The tool display box as claimed in claim 11, wherein the distal end of each said resilient holding plate has a guide section for guiding the tool into the holding space.

17. The tool display box as claimed in claim 16, wherein the guide section of each said resilient holding plate is inclined and includes a bottom surface to which a handle portion of the tool received in the holding space abuts.

18. The tool display box as claimed in claim 11, further comprising a plurality of spaced positioning pegs for retaining an end of a tool.

19. The tool display box as claimed in claim 11, further comprising a rotary member rotatably mounted to the main body for releasably engaging with an end of a tool to rotate therewith.

20. The tool display box as claimed in claim 11, further comprising, in combination: a board including information on the tool, with the main body including an insert space, with the board being releasably mounted in the insert space.

* * * * *

UNITED STATES PATENT AND TRADEMARK OFFICE

CERTIFICATE OF CORRECTION

PATENT NO. : 6,126,004
DATED : October 3, 2000
INVENTOR(S) : David Ling, et al.

It is certified that error appears in the above-identified patent and that said Letters Patent is hereby corrected as shown below:

Cover Page, line 2, after "Ling", insert --et al.--.

Cover Page, item [75], after "Ling", insert --; Bobby Hu, both of--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*